United States Patent [19]

Gasser et al.

[11] 4,150,533

[45] Apr. 24, 1979

[54] APPARATUS FOR MONITORING YARN TRAVEL AT A MULTIPLE SPINDLE SPINNING MACHINE

[75] Inventors: Hermann Gasser, Zürich; Karl Curiger, Pfäffikon, both of Switzerland

[73] Assignee: Luwa AG, Zürich, Switzerland

[21] Appl. No.: 912,312

[22] Filed: Jun. 5, 1978

[30] Foreign Application Priority Data

Jun. 9, 1977 [CH] Switzerland ..... 7103/77

[51] Int. Cl.[2] ..... D01H 13/32; D01H 11/00; D01H 13/16

[52] U.S. Cl. ..... 57/265; 57/81; 57/304

[58] Field of Search ..... 57/34 R, 34.5, 56, 80, 57/81; 340/259

[56] References Cited

U.S. PATENT DOCUMENTS 2,976,556 3/1961 Reiterer ..... 57/56 X 2,976,668 3/1961 Reiterer ..... 57/56

3,950,925 4/1976 Igel ..... 57/34 R

*Primary Examiner*—John Petrakes

*Attorney, Agent, or Firm*—Werner W. Kleeman

[57] ABSTRACT

An apparatus for monitoring yarn travel at a multiple spindle spinning machine which is equipped with a suction device servicing at least one group of the spindles. In a collecting channel of the suction device there is arranged a probe which upon passage therepast of fiber flocks or the like delivers an electrical signal to an evaluation circuit equipped with a periodically resettable signal counter having pre-settable counter value and an alarm device. The alarm device can be switched-in by means of a further cumulative counter with a higher, pre-set counter value. This further cumulative counter is coupled by means of a logic circuit with the periodically resettable signal counter in such a manner that the cumulative counter is reset whenever there is missing once or twice a signal from the periodically resettable signal counter.

8 Claims, 2 Drawing Figures

APPARATUS FOR MONITORING YARN TRAVEL AT A MULTIPLE SPINDLE SPINNING MACHINE

BACKGROUND OF THE INVENTION

The present invention relates to a new and improved construction of apparatus for monitoring yarn travel at a multiple spindle spinning machine equipped with a suction device servicing at least one group of the spindles, a probe being arranged in a collecting channel of the suction device, this probe, upon passage therepast of fiber flocks or the like delivering an electrical signal to an evaluation circuit. The evaluation circuit contains a periodically resettable signal counter having a pre-set counter value or state, the evaluation circuit being operatively coupled with an alarm device.

Now in German Pat. No. 1,685,885, and equally in the earlier German patent publication 26 43 453 there is disclosed for instance such general construction of monitoring device. With this state-of-the-art equipment there are described special measures in order that there is infed to the evaluation circuit with the greatest probability only such signals which, in fact, are predicated only upon fiber flocks which move through the collecting channel. Fiber flocks which travel in the suction channel however, in turn, are an indicia that an irregular operating state prevails at the monitored spinning machine, for instance that there has arisen rupture of a yarn or roving. With the prior art equipment there is thus not directly detected the presence or absence of an intact yarn at the spindles. Rather, based upon the material existing within the suction device a decision is reached as to the operating state of the spinning machine. Equipment of this type therefore basically is different from other, likewise prior art equipment, for instance of the type disclosed in German Pat. No. 1,907,990 or German patent publication 22 62 425, wherein by means of stationary or migrating monitoring elements there is directly detected the presence or absence, as the case may be of intact yarn at the spindles.

With the previously mentioned prior art monitoring apparatus the periodically resettable signal counter triggers the alarm device then if during one or two successive counting periods the counter value which has been pre-set at the counter has been reached or exceeded. This pre-set counter value allows determinations to be made regarding the number of yarn ruptures which have occurred. This is so because each yarn rupture—depending upon the quality and nature of the roving or the like processed at the spinning machine and as long as the spinning machine continues to operate—serves to form a sequence of timewise successive fiber flocks which are produced due to the disintegration of the still infed roving, and the recurrence within a certain time period, i.e., so-to-speak the "frequency" of the moving flocks is within comparatively narrow limits for each yarn rupture. The greater the number of yarn ruptures which have occurred that much greater is the recurrence or frequency (per counting period) of the flocks which are moving past.

As already mentioned, with the state-of-the-art monitoring device the alarm device is then first triggered, for instance for calling an operator or for turning-off the machine, when this recurrence exceeds a predetermined value, namely the counter value set at the signal counter. The system is designed with the view of first then undertaking corrective measures during the operation of the machine if, based upon the detected number of fiber flocks which move past, there can be determined such a number of yarn ruptures that the economies of further operating the spinning machine when these conditions have arisen becomes questionable. If, however, the operator takes corrective action and eliminates the yarn rupture at the spindles which require servicing during the further operation of the spinning machine, the prior art equipment does not afford for the operator any indication as to when the servicing and corrective work has progressed to an extent such that an economical further operation of the machine can be again carried out notwithstanding possibly still uncorrected yarn ruptures or yarn ruptures which have newly arisen in the meantime.

This is especially then disdadvantageous if, as is presently oftentimes the case, a single operator is responsible for the monitoring of an entire series of spinning machines. In such case the operator is not informed that the servicing or corrective work at the one spinning machine has sufficiently been accomplished so that he can discontinue his or her efforts and proceed to pay attention to a further spinning machine where likewise there has been triggered the alarm device.

Additionally, the prior art equipment is not capable of detecting all of the operating conditions which are desirable for the operator to take corrective action. For instance if per chance a yarn rupture arises at only a few spindles, at the remaining spindles however no such yarn rupture occur, then it is quite possible that this operating state can continue for a limited period of time. Since the prior art equipment only however detects the recurrence or frequency of the flocks per counting period, the flocks which are produced by the few yarn ruptures are not even capable of attaining the recurrence threshold needed for triggering the alarm device, even if the machine remains in operation over a longer period of time.

SUMMARY OF THE INVENTION

Hence, with the foregoing in mind it is a primary object of the present invention to provide an improved apparatus for monitoring yarn travel at a multiple spindle spinning machine in a manner which is not associated with the aforementioned drawbacks and limitations of the prior art proposals.

Another and more specific object of the present invention aims at the provision of a new and improved construction of apparatus of the previously mentioned type which not only more exactly monitors the operating condition or state of the spinning machine, but also is capable of indicating to the operator responsible for the maintenance when the momentary state of the maintenance or corrective work allows for the further economical operation of the spinning machine, even then if not all of the yarn ruptures have been eliminated.

Now in order to implement these and still further objects of the invention, which will become more readily apparent as the description proceeds, the proposed apparatus of the present development is manifested by the features that the alarm device can be switched-in by means of a further, cumulative counter with a higher, pre-set counter value, and this cumulative counter is coupled by means of a logic circuit with the periodically resettable signal counter in such a manner that the cumulative counter is reset whenever there is an absence of one or two signals at the signal counter.

With the proposed equipment the alarm device is thus triggered by the further cumulative counter having a higher preset counter value, which counter, however, is not periodically reset. On the other hand, the periodically resettable signal counter serves in the first instance to reset the cumulative counter and, thus, also to turn-off the alarm device.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
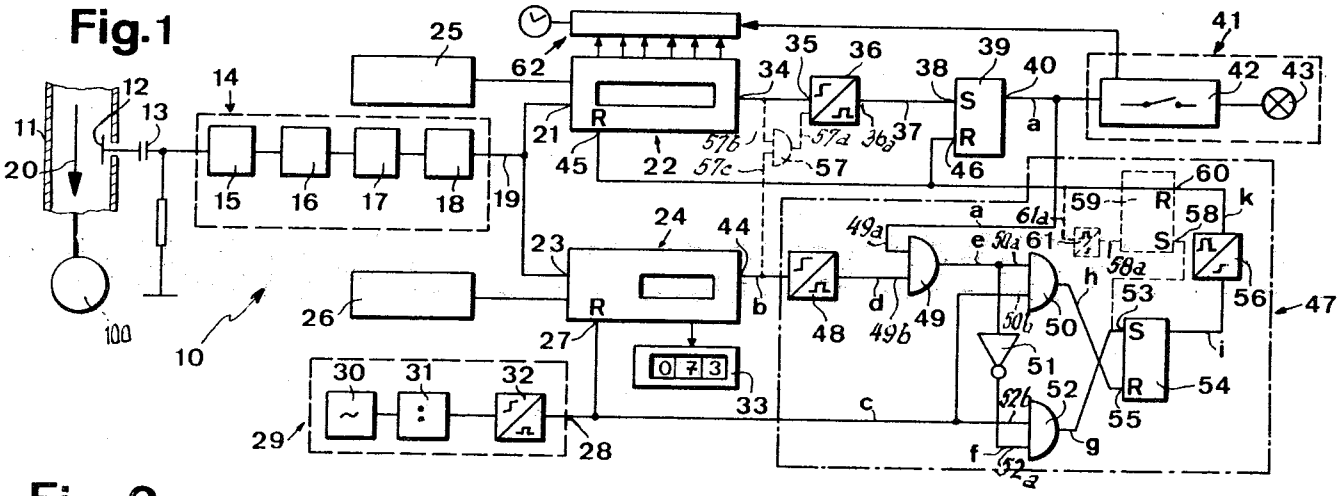
FIG. 1 is a block circuit diagram of a preferred exemplary embodiment of apparatus for monitoring yarn travel at a multiple spindle spinning machine and constructed according to the teachings of the present invention.

Describing now the drawings, with the apparatus 10 shown by way of example in FIG. 1 there will be recognized a merely schematically illustrated collecting channel or duct 11 of a conventional suction device, schematically generally indicated by reference character 100 in FIG. 1, of a spinning machine (not shown). Within the collecting channel or duct 11 there is arranged a probe or sensor 12 which is coupled by means of a coupling capacitor 13 to a digitizing discriminator stage 14. The discriminator stage 14 can be constructed, in principle, in the manner disclosed in the aforementioned German patent publication 26 43 453, to which reference may be readily had and the disclosure of which is incorporated herein by reference, and can comprise, for instance, an impedance converter 15, an amplifier 16, a filter element 17 and an amplitude discriminator 18. At the output 19 of the discriminator stage 14 there appears for each fiber flock which moves in the direction of the arrow 20 in the collecting channel or duct 11 a digital pulse of a predetermined duration, for instance of several μs.

The discriminator stage-output 19 is connected both with the counter input 21 of a cumulative counter or adder 22 and with the counter input 23 of a signal counter 24. The counter 22 which has, for instance, four or five counter decades is operatively connected with an adjustment or setting device 25 by means of which there can be pre-set a given counter value, for instance between 40,000 and 50,000 at the counter 22. The signal counter 24 which can possess, for instance, two or three counter decades, is likewise connected to a suitable adjustment or setting device 26. The reset input 27 of the signal counter 24 is connected with the output 28 of a clock generator 29, which, in turn, can contain an oscillator 30, a frequency divider 31 and a monostable multivibrator or a monoflop 32. The clock generator 29 thus, for instance, produces one pulse every ten seconds, which therefore periodically resets the signal counter 24 by means of the reset input 27. The signal counter 24 can be equipped with a display device 33 which displays the counter state attained at the moment of resetting the counter 24 during the following counting period.

Both the counter 22 as well as also the signal counter 24 deliver at their respective outputs 34 and 44 a signal as soon as and as long as their counter state has reached or exceeded the counter value which has been pre-set at the adjustment or setting devices 25 and 26 respectively.

The output 34 of the counter 22 is connected with the input 35 of a monoflop 36, whose output **36*a* is connected by means of a line 37 with the set or pre-set input 38 of a bistable multivibrator or RS-flip-flop 39. At the output 40 of this RS-flip-flop 39 there is connected by means of a line or conductor a an alarm device 41, which, in turn, can comprise a relay 42 and an optical or acoustical display or indicator element 43**.

From what has been discussed above it will be apparent that if there is only considered the full-line illustrated circuit elements of FIG. 1, then the alarm device 41 will be triggered as soon as there has been reached at the counter 22 the relevant, pre-set counter value, and specifically, initially independent of whether or not there has been delivered a signal by the signal counter 24.

Both the counter 22 as well as also the RS-flip-flop 39 each possess a reset input 45 and 46, respectively, which are connected in parallel with a line or conductor k constituting the output of a logic circuit 47 shown within the phantom line block.

The inputs of this logic circuit 47 are formed by the lines a, b and c, which, in turn, are connected with the output 40 of the RS-flip-flop 39, with the output 44 of the signal counter 24 and with the output 28 of the clock generator 29.

The line b leads to a monostable multivibrator 48 which responds without delay and flops over with delay. The multivibrator 48 thus delivers a signal at its output line or conductor d whenever and as long as a signal from the signal counter 24 appears and after its disappearance still during its flop over time. The lines a and d are connected with the inputs **49*a* and 49*b*, respectively, of a first AND-gate 49, the output e of which is directly connected with the one input 50*a* of a second AND-gate 50 and by means of an inversion element 51 and the line or conductor f is connected with the one input 52*a* of a third AND-gate 52. The other inputs 50*b* and 52*b* of the AND-gates 50 and 52, respectively, are directly connected with the line or conductor c, i.e., with the output 28 of the clock generator 29**.

The output of the AND-gate 52 has been designated by reference character g and is connected with the set or pre-set input 53 of a RS-flip-flop 54, whereas the output h of the AND-gate 50 is connected with the reset input 55 of such RS-flip-flop 54. The output i of this flip-flop 54 is connected with the input **56*a* of a monoflop 56 having a certain flop over time and responsive to ascending signal flanks or edges. The output of the monoflop 56 constitutes the output k of the logic circuit 47**.

Now based upon the graphs shown in FIG. 2 there will be explained the function of the circuitry portrayed in FIG. 1 to the extent that there is only considered at this time the circuit components illustrated with full lines. Now in FIG. 2 there have been illustrated along the lines a to k of the graphs the signal trains which appear at the lines or conductors designated by the corresponding reference characters in FIG. 1. These lines are subdivided into counting periods which have been designated by 1 to 6, $n-2$, $n-1$, n and $n+1$ and $n+2$. The counting periods are limited by the pulses of the clock generator 29 (line c) and amount to, for instance, 10 seconds.

Figure 2:
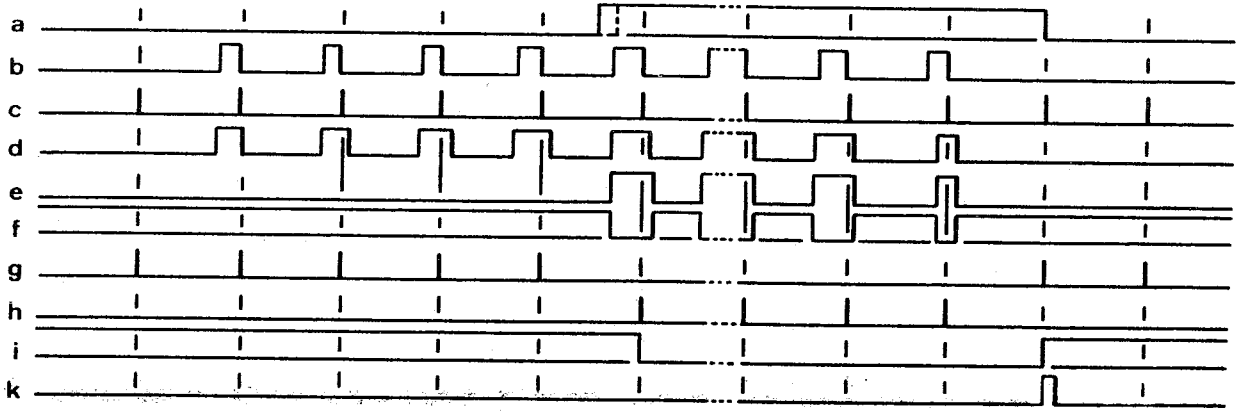
FIG. 2 is a diagram showing different signal curves during operation of the apparatus according to the showing of FIG. 1 at certain locations of the circuitry thereof.

There will be seen from FIG. 2, line b, that the signal counter 24 first reaches its pre-set value or state during the counting period 1 and thus delivers a logic "1"-signal which then again disappears during the next following reset pulse (line c). On the other hand, the counter 22 has not yet reached its pre-set counter value, so that the alarm device 41 initially is not yet triggered and the AND-gate 49 still remains blocked or non-conductive, and the signals (line d) delivered by the monostable multivibrator 48 are not switched-through. During the counting period 5 the counter state of the counter 22 attains its pre-set value and the RS-flip-flop 39 switches-through i.e., becomes conductive, so that there appears at the conductor a (line a of FIG. 2) a logic "1"-signal, which, in turn, triggers the alarm device 41, and, furthermore prevails as long as there is not delivered a reset pulse to the RS-flip-flop 39.

Now there is also switched-through to the AND-gate 49 the signals appearing at the line d, as has been illustrated by the line e of the graph of FIG. 2. Due to the delayed flop over of the monostable multivibrator 48 there appears during the duration of each logic "1"-signal at the line or conductor d and therefore also at the line e a clock pulse, so that these clock pulses only then appear at the output h of the AND-gate 50 (line h of the graph of FIG. 2) when there simultaneously appears at its input 50*a* i.e., the line or conductor e also a logic "1"-signal or pulse (line e of the graph of FIG. 2).

As long as there does not appear any signal at the output of the logic gate 49, the inversion element 51 delivers a logic "1"-signal and vice versa (line f of the graph of FIG. 2). The AND-gate 52 thus switches-through all of the clock pulses appearing at its input 52*b* i.e., the line or conductor c to its output g (line g of the graph of FIG. 2), which, in turn, insures that the RS-flip-flop 54 remains switched-through or conductive for such length of time as there does not appear at the line e a logic "1"-signal. This has been illustrated in line i of the graph of FIG. 2. As soon as however there appears at the line e a logic "1"-signal, then the AND-gate 52, by virtue of the inversion element 51, blocks the incoming clock pulses, whereas the clock pulses (line h, end of the counting period 5) appearing at the output of the AND-gate 50 reset the RS-flip-flop 54. This condition prevails for such length of time as the signal counter 24 reaches, during the counting periods dictated by the clock generator 29, the pre-set value, i.e., as long as the frequency or recurrence of the flocks which move past the probe or center 12 constitute an indication that the corrective or servicing work has not yet reached an operating state of the machine which allows for an economical further operation of the monitored spindles of the spinning machine. During further progression of the corrective or repair work of course such flock frequency or recurrence decreases, so that the value pre-set at the signal counter 24 increasingly is reached towards the end of a counting period. This leads to the appearance at the line b of signals of progressively shorter duration, as such has been illustrated in line b of the graph of FIG. 2, counting periods (n−2) and (n−1). It is now assumed that at the end of the counting period n the signal counter 24 no longer reaches the pre-set counter value, so that the corresponding signal at the line b and therefore also at the lines d and e disappears. As a result, the AND-gate 52 (by virtue of the inversion element 51) becomes conductive and the clock pulse (line c of the graph of FIG. 2) appearing at the end of the counting period n is switched-through by the AND-gate 52 to the line or conductor g, with the result that the RS-flip-flop 54 is again switched-through, i.e, at its output the signal state flips over from the logic signal "0" to the logic signal "1". Since the monoflop 56 only responds to ascending signal flanks or edges, there now appears at its output a signal (line k of the graph of FIG. 2) which by means of the line k resets both the counter 22 as well as also the RS-flip-flop 39. The counter 22 may have attained in the meantime a state which far exceeds the pre-set value, which possibly exceeds the inherent counter capacity. However, this is irrelevant because there appears at the output of the RS-flip-flop 39 a logic "1"-signal for such time as there is not delivered to the flip-flop 39 any reset signal.

In certain situations it may be desired that for triggering the alarm device 41 there not only be fulfilled the condition that the counter 22 has reached the counter value which has been pre-set thereat, rather also the additional condition that the signal counter 24 delivers a signal. In other words: the alarm should be triggered if, on the one hand, there has been reached the absolute value of the flocks detected by the probe or sensor 12 since the last resetting of the counter 22, and, on the other hand, the frequency or recurrence of the flocks appearing during a counting period has exceeded the value pre-set at the signal counter 24. This can be simply accomplished by virtue of the fact that the input 35 of the monoflop 36 is not directly connected with the output 34 of the counter 22, rather with the output 57*a* of an AND-gate 57 shown in phantom lines in FIG. 1, the inputs 57*b* and 57*c* of which are connected with the output 34 of the counter 22 and with the output 44 of the signal counter 24, respectively. The only change which would then arise for the signal train or sequence shown in the graphic illustrations of FIG. 2 would be a delay in the triggering of the alarm device 41 in the counting period 5 as has been shown in line a of the graph of FIG. 2 by the broken lines.

Equally, it may be desired that the resetting of the counter 22 and the alarm device 41 is not accomplished during the first absence of a signal at the counter 24, rather upon the absence of such signal during two successive counting periods. This can be accomplished, by way of example, by augmenting the logic circuit 47 within the broken line block in that the line or conductor g also is connected with the set or pre-set input 58 of a RS-flip-flop 59 having delayed switching-through action and that the output of the monoflop 56 is connected with the reset input 60 of such flip-flop 59. The output 59*a* of this flip-flop 59 is connected with a further monoflop 61 responsive to ascending edges or flanks, and the output 61*a* of such monoflop 61 is connected with the reset inputs 45 and 46 of the counter 22 and the RS-flip-flop 39, respectively. In this case the reset pulse first appears at the end of the counting period n+1.

Finally, it is to be mentioned that the counter 22 as well as the alarm device 41 can be connected with a service hour counter 62 having a printer (not shown) where there can be recorded the frequency and the duration of the alarm conditions.

While there are shown and described present preferred embodiments of the invention, it is to be distinctly understood that the invention is not limited thereto, but may be otherwise variously embodied and practiced within the scope of the following claims. ACCORDINGLY,

What we claim is:

1. An apparatus for monitoring yarn travel at a multiple spindle spinning machine comprising:

means defining a suction device servicing at least one group of spindles;

said suction device embodying a collecting channel;

a probe arranged within the collecting channel;

an evaluation circuit operatively connected with said probe;

said probe delivering an electrical signal to said evaluation circuit upon passage of fiber flocks past said probe within said collecting channel;

said evaluation circuit being provided with a periodically resettable signal counter having a pre-settable counter value;

said evaluation circuit further being provided with an alarm device;

a cumulative counter having a higher pre-set counter value operatively connected with said alarm device; and a logic circuit for connecting said cumulative counter with the periodically resettable signal counter in such a manner that said cumulative counter is reset whenever there is absent once or twice a signal from the periodically resettable signal counter.

2. The apparatus as defined in claim 1, wherein:

said cumulative counter has an output;

a monostable multivibrator and a first bistable multivibrator for coupling said output of said cumulative counter with said alarm device;

said cumulative counter and said bistable multivibrator each having a reset input;

said logic circuit having an output;

said reset inputs of said cumulative counter and said first bistable multivibrator being connected in parallel with the output of said logic circuit.

3. The apparatus as defined in claim 2, wherein:

said first bistable multivibrator has an output;

a first AND-gate having a first input and a second input and an output;

said periodically resettable signal counter having an output;

said output of the first bistable multivibrator being connected with said first input of said AND-gate; and said second input of said AND-gate being connected with said output of said periodically resettable signal counter.

4. The apparatus as defined in claim 3, wherein:

said periodically resettable signal counter has a reset input;

a clock generator having an output;

said reset input of said periodically resettable signal counter being connected with said output of said clock generator;

a respective second and third AND-gate;

each said second and third AND-gate having first and second inputs;

the output of said clock generator being connected with a respective one of the first inputs of said second and third AND-gates;

the respective second inputs of said second and third AND-gates being directly and inversely connected with the output of the first AND-gate.

5. The apparatus as defined in claim 4, wherein:

each said second and third AND-gate has a respective output;

a second bistable multivibrator having a set input and a reset input and an output;

the output of the third AND-gate being connected with the set input of said second bistable multivibrator;

the output of said second AND-gate being connected with the reset input of said second bistable multivibrator;

a monostable multivibrator;

the output of the second bistable multivibrator being connected by means of said monostable multivibrator with the reset inputs of the cumulative counter and the first bistable multivibrator.

6. The apparatus as defined in claim 5, further including:

a fourth AND-gate having first and second inputs and an output;

the output of the cumulative counter being connected with the first input of the fourth AND-gate;

the second input of said fourth AND-gate being connected with the output of the periodically resettable signal counter; and the output of said fourth AND-gate being connected with said monostable multivibrator.

7. The apparatus as defined in claim 5, further including:

a third bistable multivibrator having delayed switching-through action;

said third bistable multivibrator having a set input and a reset input and an output;

the output of the third AND-gate being connected with said set input of the third bistable multivibrator;

the reset input of the third bistable multivibrator being connected with the output of the monostable multivibrator;

the output of the third bistable multivibrator being connected with the reset inputs of the cumulative counter and the first bistable multivibrator.

8. The apparatus as defined in claim 7, further including:

an additional monostable multivibrator responsive to ascending signal flanks;

the output of the third bistable multivibrator being connected by means of said additional monostable multivibrator with the reset inputs of the cumulative counter and the first bistable multivibrator.

* * * * *